US005688130A

United States Patent [19]

Huang

[11] Patent Number: 5,688,130

[45] Date of Patent: Nov. 18, 1997

[54] ELECTRICAL CONNECTOR ASSEMBLY FOR PC CARDS

[75] Inventor: San-Shan Huang, Taipei, Taiwan

[73] Assignee: Molex Incorporated, Lisle, Ill.

[21] Appl. No.: 634,750

[22] Filed: Apr. 10, 1996

[51] Int. Cl.[6] ..... H01R 13/658; H01R 9/09

[52] U.S. Cl. ..... 439/79; 439/541.5; 439/607

[58] Field of Search ..... 439/79, 80, 541.5, 439/607, 608, 609

[56] References Cited

U.S. PATENT DOCUMENTS

| | | | |
|---|---|---|---|
| 5,273,460 | 12/1993 | Arai | 439/609 |
| 5,277,624 | 1/1994 | Champion et al. | 439/607 |
| 5,286,207 | 2/1994 | McHugh | 439/64 |
| 5,288,247 | 2/1994 | Kaufman | 439/607 |
| 5,299,089 | 3/1994 | Lwee | 439/541.5 |
| 5,305,182 | 4/1994 | Chen | 439/79 |
| 5,334,046 | 8/1994 | Brouillette et al. | 439/541.5 |
| 5,399,105 | 3/1995 | Kaufman | 439/609 |
| 5,470,259 | 11/1995 | Kaufman et al. | 439/607 |
| 5,478,260 | 12/1995 | Kaufman et al. | 439/609 |
| 5,490,791 | 2/1996 | Yamadat et al. | 439/159 |

FOREIGN PATENT DOCUMENTS

| | | |
|---|---|---|
| 6-168758 | 6/1984 | Japan . |
| 5-189625 | 7/1993 | Japan . |

OTHER PUBLICATIONS

PC Card Standard, Document 0295–03–1500 (Figs. 35& 36).

*Primary Examiner*—Neil Abrams
*Attorney, Agent, or Firm*—Stacey E. Caldwell

[57] ABSTRACT

A grounding system is disclosed in an electrical connector assembly which provides an interconnection between a pc card and a printed circuit board. The assembly includes a header connector subassembly having a body adapted for receiving the pc card. A plurality of header terminals are mounted on the body, with pin portions of the terminals adapted for interconnection to receptacle contacts of the pc card. A grounding shroud is disposed over the terminal and includes downwardly extending grounding terminal portions. A board-mounted connector subassembly includes a housing adapted for mating with the body of the header connector subassembly. A plurality of socket terminals are mounted on the housing for mating with the header terminals of the header connector subassembly, with socket tail portions adapted for interconnection with circuit traces on the printed circuit board. A ground terminal on the housing mates with the grounding terminal portion of the shroud, with a solderable portion of the ground terminal adapted for interconnection to a ground circuit on the printed circuit board.

18 Claims, 5 Drawing Sheets

ELECTRICAL CONNECTOR ASSEMBLY FOR PC CARDS

FIELD OF THE INVENTION

This invention generally relates to the art of pc cards and, particularly, to an improved electrical connector assembly for connecting one or more pc cards to a printed circuit board.

BACKGROUND OF THE INVENTION

Generally, pc cards, such as memory cards, are information storage devices which are electrically connected to an underlying electronic apparatus, such as a word processor or personal computer. The information stored in the pc card is transferred to or accessed by the electronic apparatus as required. Pc cards are portable instruments which are readily inserted and extracted from a connector of the electronic apparatus, which connector removably couples the pc card to a printed circuit board. The connector is typically in the form of a right angle header connector.

A typical pc card is shielded by a conductive cover to protect the electrical circuitry and, in particular, the electronic signals from externally generated radiated emissions. The card also is typically provided with EMI or grounding contacts along outside edges thereof to provide early discharge of internally generated static electricity in order to minimize the effects of electromagnetic pulses created during the dissipation of static charges through the signal contacts. Typically, according to such standards as PCMCIA, two grounding contacts are located on the outside edges of the pc card for engagement with corresponding grounding contacts inside guide arms of a card-receiving connector. This standard grounding configuration addresses reduction of electrostatic discharge and EMI/RFI effects but does not address the effects of signal distortion.

In a given electrical circuit with given inductance and resistance values, the current flowing through the signal terminals should be balanced with the current flowing through the ground returns. If this balance is not achieved, voltage build-up can occur and a ground current can form, resulting in distortion of the electrical signals and the creation of "ground bounce". Furthermore, at high switching speeds existing ground pins in a header connector often are insufficient, and if the grounding locations are connected to the ground pins, a resulting current flow is created from the ground pins through the conductive cover of the pc card and to the guide grounds, thus creating a "ground loop".

In order to prevent such phenomena as ground bounce and ground loops in high speed connectors, and particularly in pc card connectors in computer applications, grounding shrouds have been used on card-receiving header connectors to electrically connect the ground of the pc card to the ground of the equipment in which the card is being used. The shroud typically includes a plurality of contact fingers which engage the conductive cover of the pc card to balance the ground returns with the current flow to decrease voltage build-up and minimize the occurrence of ground bounce and ground loops. An example of such a grounding shroud is shown in U.S. Pat. No. 5,288,247 dated Feb. 22, 1994.

However, due to the ever-increasing demand in today's computer applications for additional memory and peripheral add-on functions, more card-receiving connectors are arranged in "dual port" or stacked card-receiving connector configurations. However, it becomes more costly and more complicated to assemble the grounding shrouds and card-receiving connector to the underlying printed circuit board in a stacked configuration, because both the grounding shrouds and the card-receiving connectors include a plurality of tails which must be soldered directly to circuit traces on the printed circuit board. An example of a dual port stacked card-receiving connector configuration with grounding shrouds and connector terminal tails soldered to a printed circuit board is shown in U.S. Pat. No. 5,399,105 dated Mar. 21, 1995.

One problem associated with soldering the entire dual port assembly consisting of the card-receiving connector tails and the grounding shroud tails to the printed circuit board is that it is difficult to solder each individual tail and ensure that none of the closely spaced solder fillets are short circuited to an adjacent fillet. In addition, upon completion of soldering the tails of the connectors and of the shroud to the printed circuit board, it is extremely difficult to visually inspect each solder joint.

Another problem associated with soldering the connector tails and the shroud tails of the dual port assembly to the printed circuit board is that, if any of the connectors or the grounding shrouds need to be replaced or removed for any reason, the removal of one may require desoldering the entire dual port connector assembly. This process can be extremely labor intensive and costly in terms of time and replacement parts. Although some prior art dual port pc card-receiving connectors are connected to the underlying circuit board by way of separate board-mounted connectors, the grounding shroud tails still are soldered directly to the board. The problems enumerated above therefore still exist, particularly since the shrouds overlie the header connector terminals and prevent access thereto and visual inspection thereof.

The present invention is directed to solving the above problems by providing an electrical connector assembly for connecting one or more pc cards to a printed circuit board, wherein the assembly includes a card-receiving connector subassembly in the form of a header connector subassembly and a separate mating board-mounted connector subassembly. One or more grounding shrouds are used with the header connector subassembly and mate with ground terminals on the board-mounted connector subassembly. Therefore, no component of the header connector subassembly including header terminals, grounding shroud terminals or any other contacts are soldered directly to the underlying printed circuit board and are therefore removably connected to the circuit board so that when placing or removing one or more components to or from the circuit board, no soldering or desoldering needs to take place.

SUMMARY OF THE INVENTION

An object, therefore, of the invention is to provide a new and improved electrical connector assembly which provides an interconnection between the contacts of an pc card and the circuit traces of a printed circuit board.

The invention is embodied in an electrical connector assembly which includes a header connector subassembly having a card-receiving body for receiving the pc card. A plurality of header terminals are mounted on the body, with pin portions of the terminals adapted for interconnection with receptacle contacts of the pc card. A grounding shroud is disposed over the header terminals and includes a downwardly extending grounding terminal portion. A board-mounted connector subassembly includes a housing adapted for mating with the body of the header connector subassembly. A plurality of card-receiving socket terminals are mounted on the housing for mating with the header terminals of the header connector subassembly, with socket terminating portions adapted for interconnection with the circuit traces on the printed circuit board. A ground terminal on the housing receives the grounding terminal portion of the shroud and includes a soldering portion adapted for interconnection to a ground circuit on the printed circuit board.

The header connector and board-mounted connector subassemblies are generally elongated and have opposite ends, with the header terminals and socket terminals extending in an array between the ends. The grounding terminal portion of the grounding shroud and the ground terminal of the board-mounted connector subassembly are located at one end of the array of terminals. Preferably, one of the grounding terminal portions and the ground terminal are provided at each opposite end of the array of terminals. The grounding shroud is generally planar and extends longitudinally between the opposite ends of the array of terminals, and the grounding terminal portion comprises a ground tail projecting downwardly generally perpendicular to the planar shroud.

Other features of the system include a plurality of flexible fingers on the grounding shroud for engaging projections on an outer conductive surface of the pc card. The header terminals of the header connector subassembly include tail portions for mating with the socket terminals of the board-mounted connector subassembly, and a tail aligner is provided on the body of the header connector subassembly for receiving and positioning the tail portions of the header terminals. The tail aligner is independent of the body.

Lastly, the invention is disclosed herein in a dual port electrical connector assembly configuration. In other words, the body is adapted for receiving a pair of pc cards in a stacked relationship. A set of header terminals for each pc card is mounted on the body, with the aforesaid grounding shroud being disposed between the sets of terminals. As disclosed herein, the body includes first and second body parts with a grounding shroud positioned therebetween. The two sets of header terminals include an inner row and an outer row. Preferably, a second grounding shroud is located over the terminals in the outer row thereof. The second grounding shroud also includes at least one grounding terminal portion for mating with a ground terminal of the board-mounted connector subassembly.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
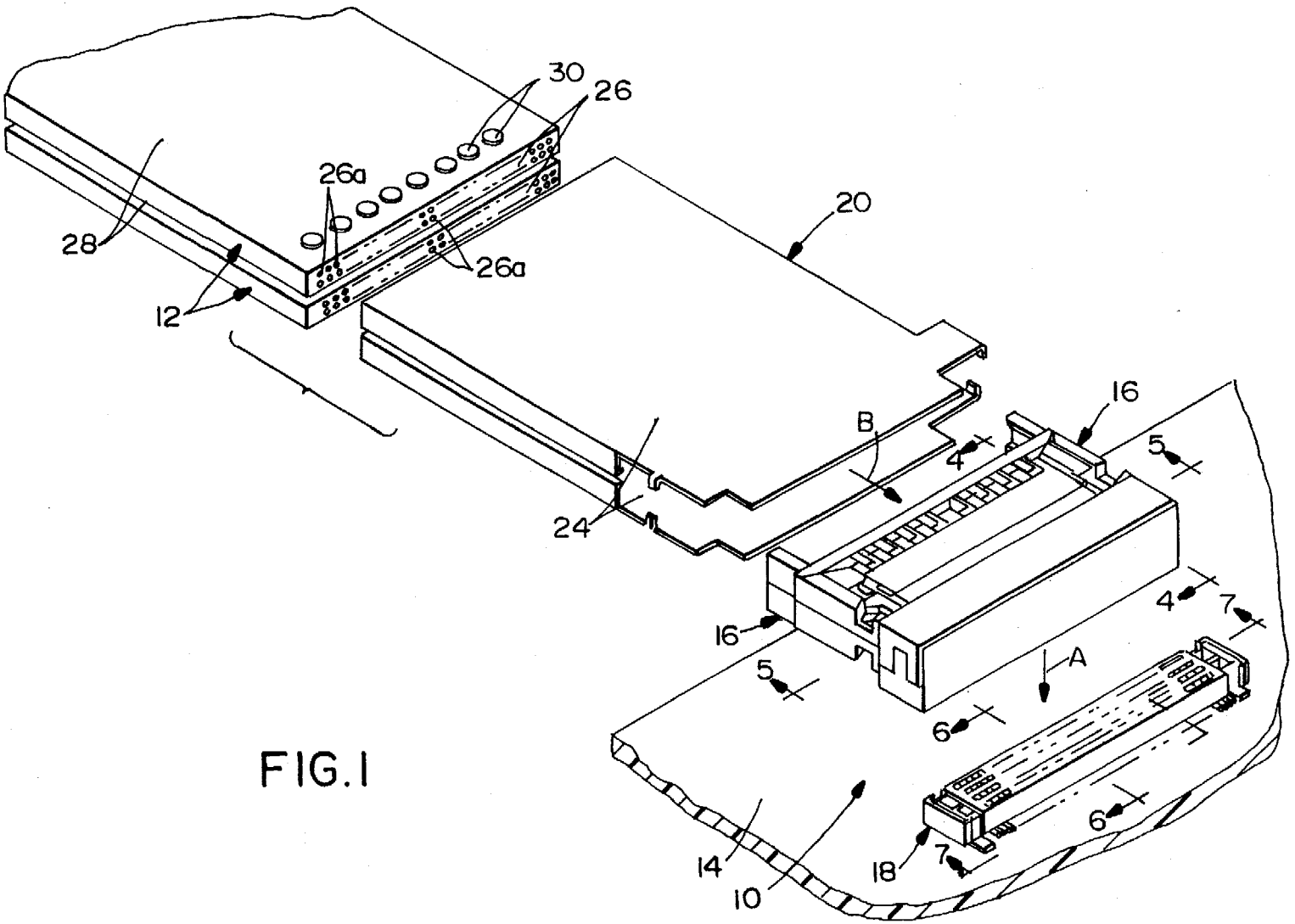
FIG. 1 is an exploded perspective view of an electrical connector assembly according to the invention, in conjunction with a pair of pc cards and a card guide used with the assembly.

Referring to the drawings in greater detail, and first to FIG. 1, the invention is embodied in an electrical connector assembly, generally designated 10, which provides an interconnection between the contacts of one or more pc cards, generally designated 12, and circuit traces on a printed circuit board 14. Generally, electrical connector assembly 10 includes a header connector subassembly, generally designated 16, and a board-mounted connector subassembly, generally designated 18, mateable in the direction of arrow "A". As will be seen hereinafter, header connector subassembly 16 has header terminals for interconnection with the contacts of pc cards 12, and board-mounted connector subassembly 18 has socket terminals for interconnection to the circuit traces on printed circuit board 14. Lastly, a card guide 20 is used in conjunction with header connector subassembly 16 to guide pc cards 12 into mating condition therewith.

The details of pc cards 12 and card guide 20 are not critical to the invention herein, and therefore the details of the pc cards and card guide are not shown in the drawings. Generally speaking the card guide includes top and bottom guide walls 24 fabricated of sheet metal material. The card guide further includes some form of fastening device to secure the card guide to the rear of header connector subassembly 16 so that the pc cards can be guided in the direction of arrow "B" into mating condition with the header connector subassembly. The pc cards have receptacle connectors 26 at their front ends, with receptacle contacts **26*a* for mating with the header terminals of header connector subassembly 16, as is known in the art. Finally, the pc cards each include top and bottom conductive covers 28 and may include grounding projections 30 on the top cover near the forward or insertion ends of the cards for mating to a corresponding grounding portion of the board-mounted connector subassembly 18**, as described in more detail below.

Figure 2:
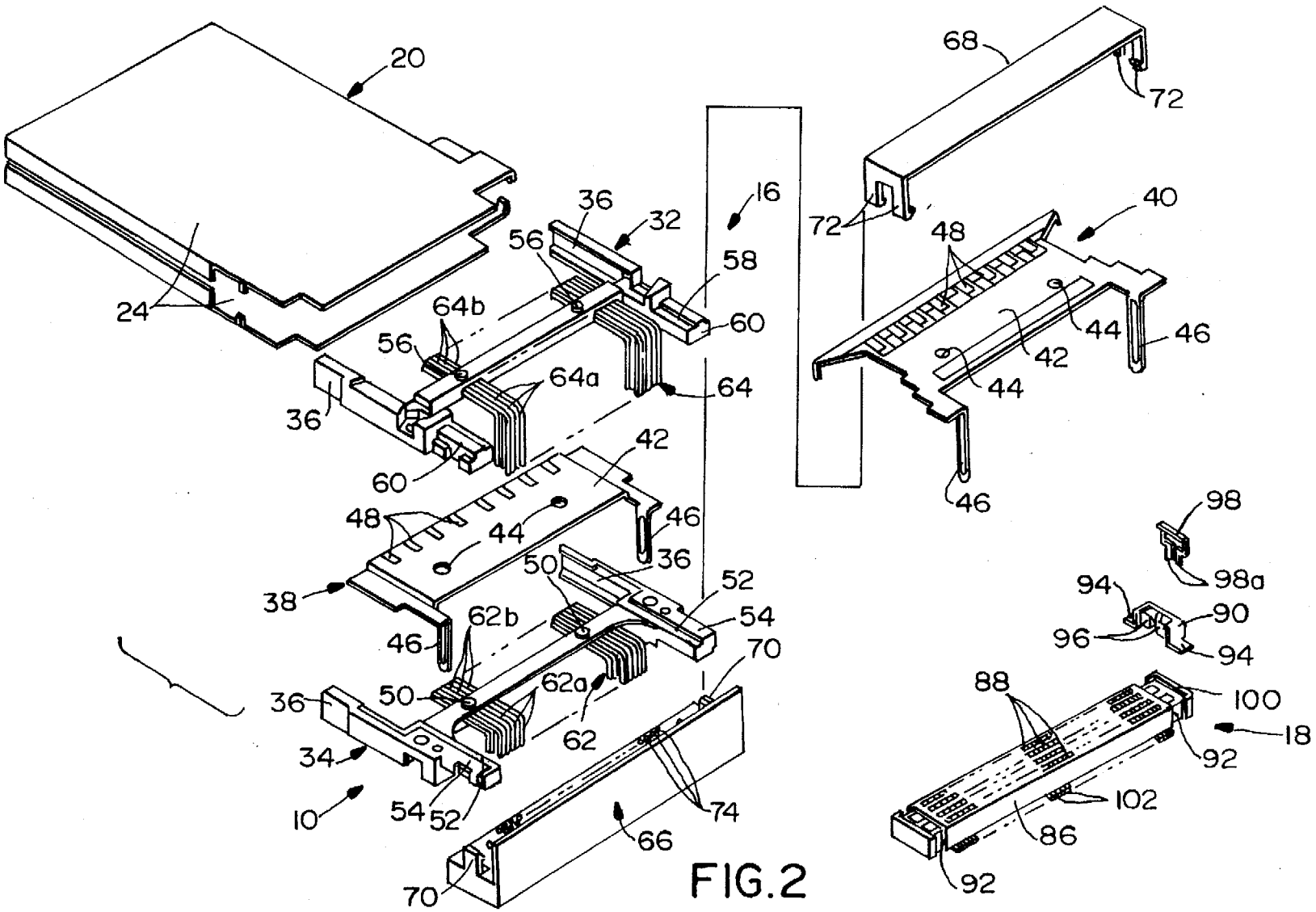
FIG. 2 is an exploded perspective view of the connector assembly, showing in greater detail the components of the header connector subassembly and the board-mounted connector subassembly, again in conjunction with the card guide used with the assembly.
Figure 3:
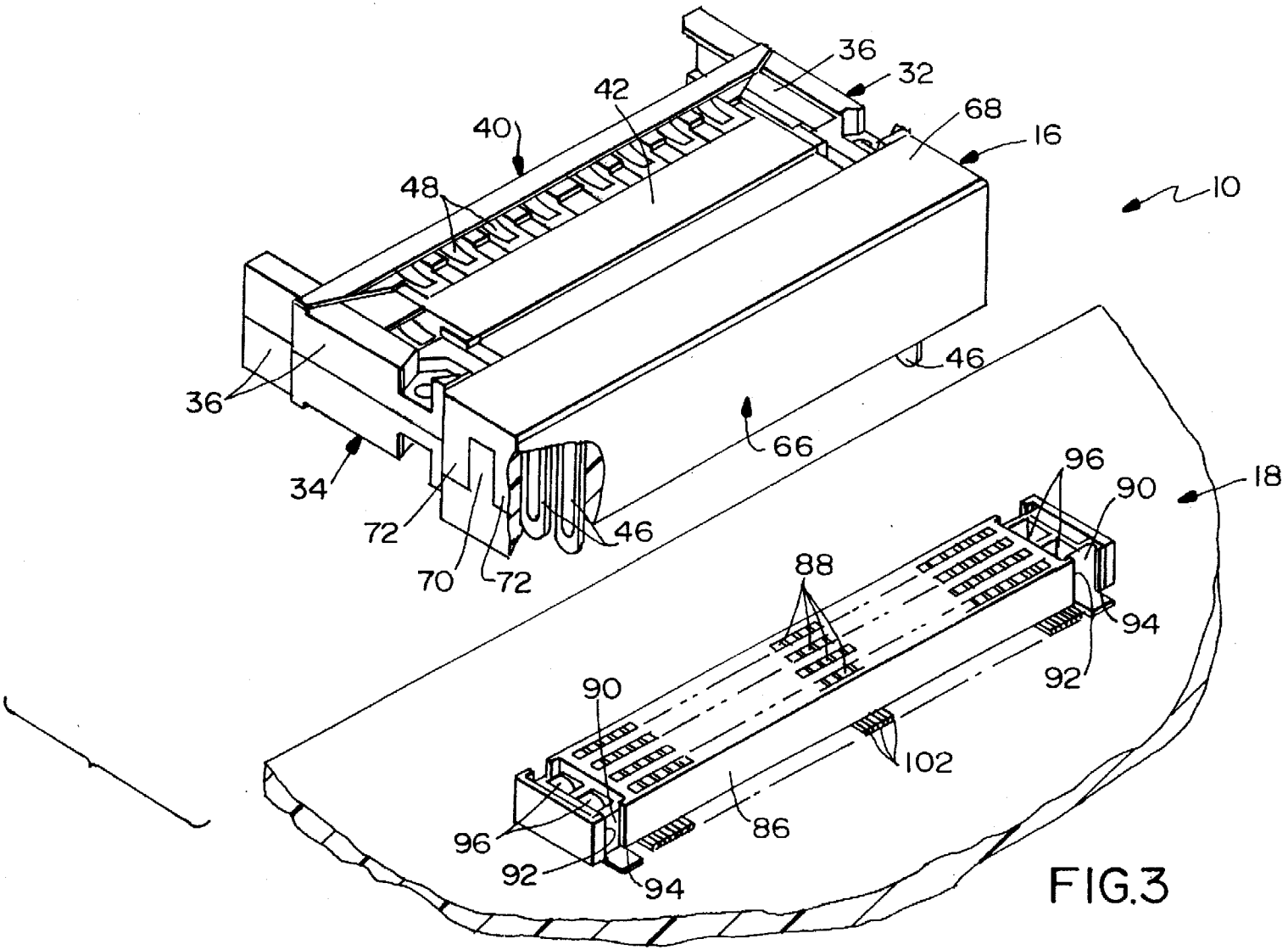
FIG. 3 is an enlarged perspective view of the header connector subassembly and the board-mounted connector subassembly in unmated condition.

Referring to FIGS. 2 and 3 in conjunction with FIG. 1, header connector subassembly 16 includes an elongated dielectric body comprised of an elongated upper body part, generally designated 32, and an elongated lower body part, generally designated 34. Each body part includes a pair of outside arms 36 having channels on the inside thereof for receiving one of the pc cards 12. The dual port connector configuration of header connector subassembly 16 is therefore adapted to receive two pc cards.

Further components of header connector subassembly 16 shown in FIG. 2 include an intermediate grounding shroud, generally designated 38, and a top grounding shroud, generally designated 40. Each grounding shroud 38 and 40 is stamped and formed of conductive metal material and includes an elongated plate portion 42 extending lengthwise along body parts 32 and 34 with a pair of holes 44 formed therethrough a pair of grounding terminal tails 46 at opposite ends of the plate portion, and a plurality of grounding fingers 48 along a front edge of the plate portion.

Intermediate grounding shroud 38 is positioned between upper and lower body parts 32 and 34, with holes 44 in plate portion 42 fitting over bosses 50 of the lower body part. Grounding terminal tails 46 of intermediate grounding shroud 38 extend downwardly through slots 52 in rearwardly projecting arms 54 of the lower body part. Flexible grounding fingers 48 of intermediate grounding shroud 38 engage the grounding projections 30 of lower pc card 12 (FIG. 1) when the card is inserted into header connector subassembly 16.

Top grounding shroud 40 is disposed on top of upper body part 32, with holes 44 in plate portion 42 of the top grounding shroud fitting over bosses 56 formed on the upper body part. Grounding terminal tails 46 of top grounding shroud 40 extend downwardly through a pair of slots 58 in a pair of rearwardly projecting arms 60 of the upper body part and then through slots 52 in the lower body part.

Intermediate and top grounding shrouds 38 and 40 are positioned generally about a plurality of header terminals 62 mounted in lower body part 34 and a plurality of header terminals 64 mounted in upper body part 32. The terminals of each body part are generally parallel to each other, and the terminals extend in an array lengthwise of the header connector assembly. Terminals 62 in lower body part 34 are generally L-shaped and include downwardly projecting tail portions **62*a* and forwardly projecting pin portions 62*b*. Pin portions 62*b* are adapted for insertion into receptacle contacts 26*a* of receptacle connector 26 at the face of lower pc card 12 (FIG. 1). It can be seen that tail portions 62*a* are arranged in two rows longitudinally of lower body part 34, and pin portions 62*b* also are arranged in two longitudinal rows for mating with the longitudinal rows of receptacle contacts 26*a*** of the lower pc card.

Similarly, header terminals 64 mounted on upper body part 32 are generally L-shaped, with two rows of downwardly projecting tail portions **64*a* and two rows of forwardly projecting pin portions 64*b*. Like the set of header terminals in lower body part 34, pin portions 64*b* of terminals 64 of the upper body part are adapted for insertion into receptacle contacts 26*a* of upper pc card 12 (FIG. 1**).

Other components of header connector subassembly 16 shown in FIGS. 2 and 3 include a tail aligner, generally designated 66, interengageable with a cover, generally designated 68, both of which are mounted about rearwardly projecting arms 54 of lower body part 34 and rearwardly projecting arms 60 of upper body part 32. The mounting of the tail aligner and cover will be seen more clearly hereinafter. FIG. 2 shows that tail aligner 66 has a hooked snap-latch arm 70 at each opposite end thereof, and cover 68 has a pair of hooked snap-latch arms 72 at each opposite end thereof. It can be seen in FIG. 3 that snap-latch arms 70 of tail aligner 66 are positionable between snap-latch arms 72 of cover 68. Lastly, tail aligner 66 has a plurality of apertures 74 (FIGS. 2 and 3) through which the downwardly projecting tail portions **62*a* and 64*a* of terminals 62 and 64**, respectively, project so that the tail aligner properly positions the tail portions.

Figure 4:
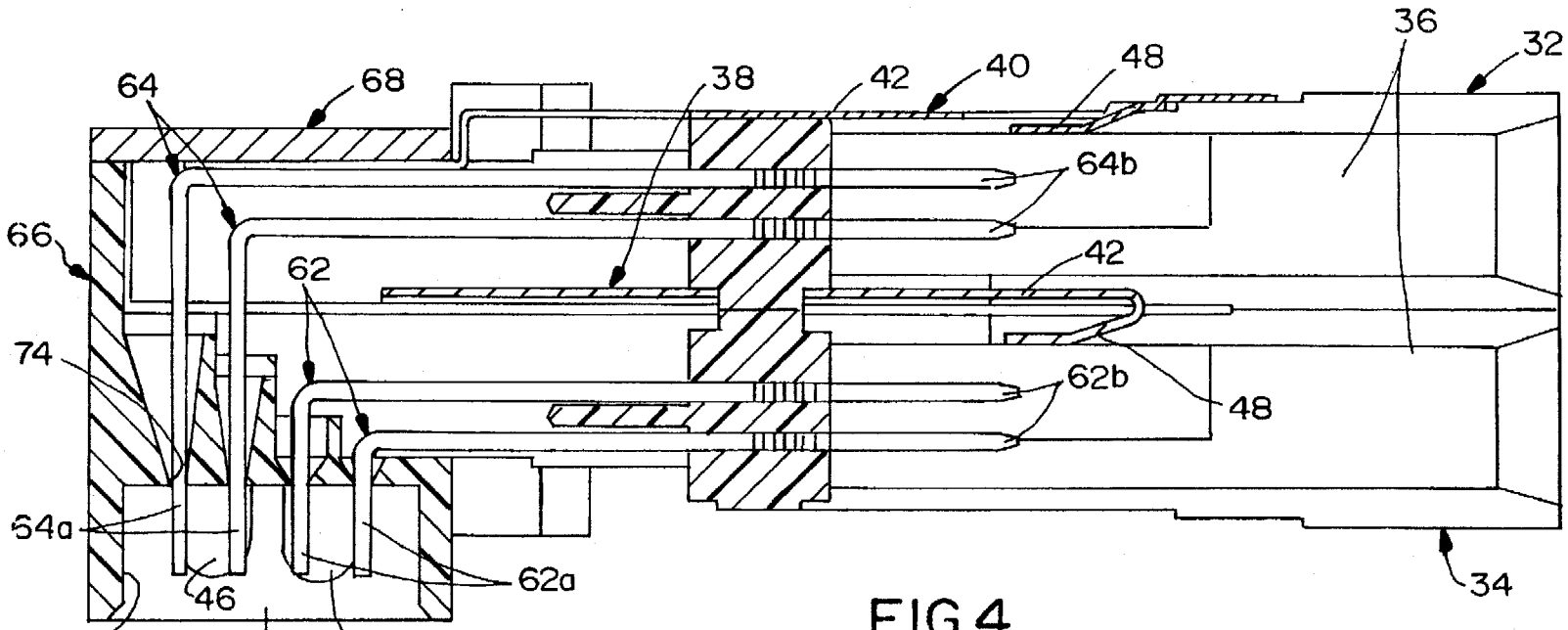
FIG. 4 is an enlarged vertical section through the header connector subassembly taken generally along line 4—4 of FIG. 1.

FIG. 4 shows that tail portions **62*a* of terminals 62 and tail portions 64*a* of terminals 64 extend downwardly through tail aligner 66 in four rows, with cover 68 positioned above the tail aligner to protect the terminals. Actually, it can be seen that the distal ends of tail portions 62*a* and 64*a* are disposed and protected within a recessed area or receptacle 76 at the bottom of the tail aligner. FIG. 4 also shows how the terminals extend through upper and lower body parts 32 and 34 whereby the pin portions 62*b* are in two rows and pin portions 64*b* are in two rows for mating with the receptacle contacts of the two pc cards. Intermediate grounding shroud 38 is shown between body parts 32 and 34 with top grounding shroud 40 disposed on top of the subassembly whereby the grounding shrouds are positioned about the subjacent terminals. Lastly, FIG. 4 shows how flexible fingers 48 are stamped and formed near the edges of the grounding shrouds and project inwardly for engaging grounding projections 30 (FIG. 1) of conductive covers 28 of the pc cards, as described above in relation to FIG. 1**.

Figure 5:
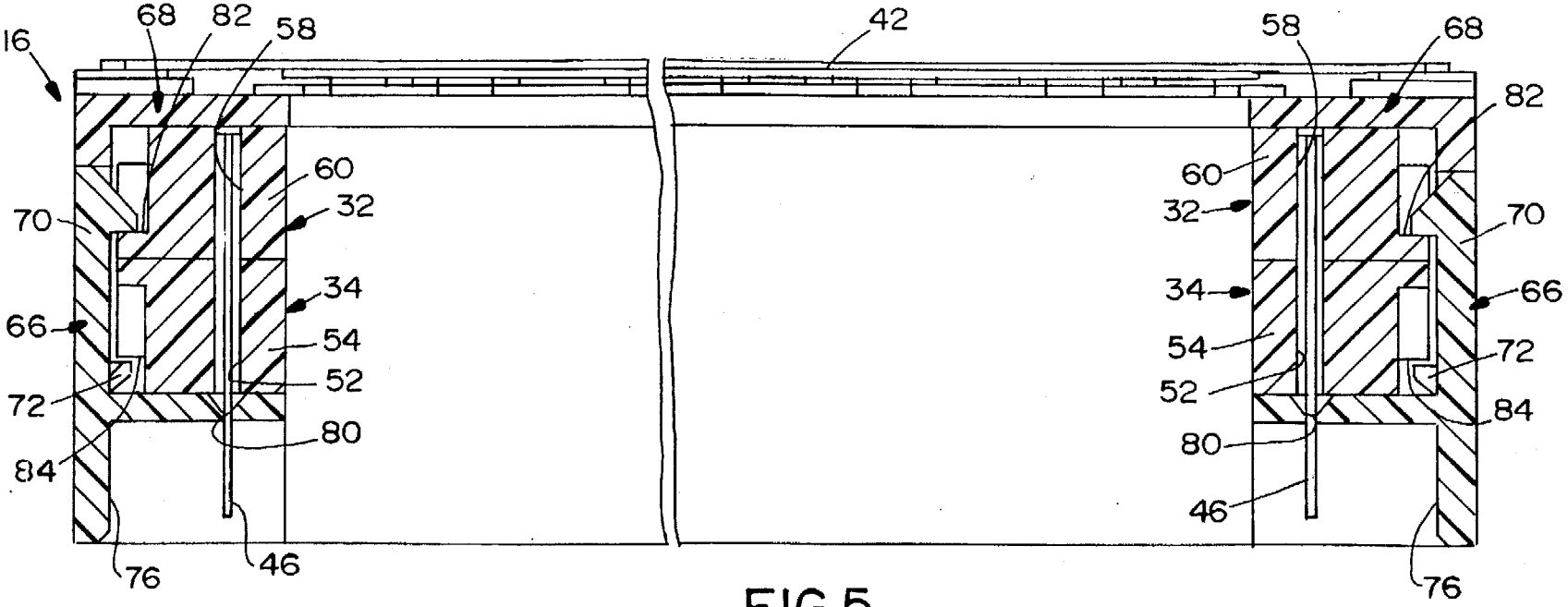
FIG. 5 is an enlarged vertical section through the header connector subassembly taken generally along line 5—5 of FIG. 1.

FIG. 5 shows how grounding tails 46 of the grounding shrouds project downwardly through slots 58 in arms 60 of upper body part 32 and then through slots 52 in arms 54 of lower body part 34 and through apertures 80 in tail aligner 66. The distal ends of the grounding tails 46 are located within the recessed area or receptacle 76 at the bottom of tail aligner 66. FIG. 5 also shows how hooked snap-latch arms 70 of the tail aligner engage behind shoulders 82 of upper body part 32, while hooked snap-latch arms 72 of cover 68 snap beneath shoulders 84 of lower body part 34. This interengagement holds the upper body part in assembly with the lower body part and, in turn, the tail aligner and the cover to complete the assembly of header connector subassembly 16.

Figure 6:
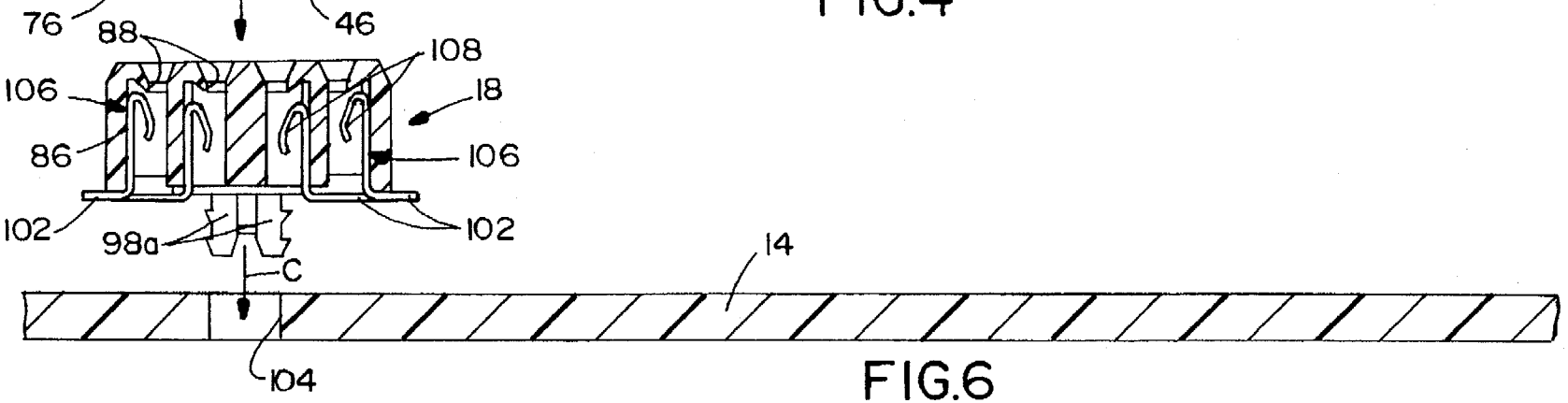
FIG. 6 is an enlarged vertical section through the board-mounted connector subassembly taken generally along line 6—6 of FIG. 1.
Figure 7:
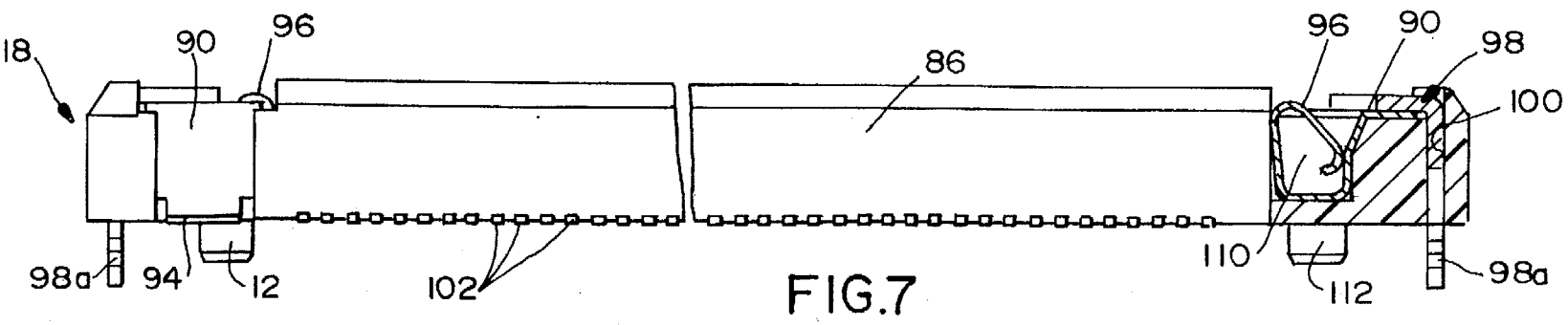
FIG. 7 is an enlarged vertical section through the board mounted connector subassembly taken generally along line 7—7 of FIG. 1.

Turning back to FIGS. 2 and 3 in conjunction with FIGS. 1, 6 and 7, board-mounted connector subassembly 18 includes an elongated housing 86 having four rows of passages 88 for receiving the four rows of tail portions **62*a* and 64*a* of terminals 62 and 64, respectively. A ground terminal 90 is mounted near each opposite end of elongated housing 86 within respective grooves 92 molded in the housing. Each ground terminal 90 includes a pair of planar soldering portions 94 for soldering to corresponding ground circuit traces on printed circuit board 14. Each ground terminal 90 also includes a pair of spring contact fingers 96 (FIG. 7) for engaging grounding tails 46 of grounding shrouds 38 and 40. A boardlock 98 (FIG. 6) is insertable through a slot 100 at each opposite end of housing 96, with barbed bifurcated legs 98*a* insertable into corresponding mounting holes in the printed circuit board. Housing 86 of board-mounted connector subassembly 18 mounts a plurality of socket terminals 106 having tail portions 102 for soldering such as by surface mounting to appropriate circuit traces on printed circuit board 14**.

Looking still at FIGS. 5, 6 and 7, board-mounted connector subassembly 18 is shown with barbed legs **98*a* of one of the boardlocks 98 prior to insertion in the direction of arrow "C" into a mounting hole 104 in printed circuit board 14. Housing 86 mounts a plurality of terminals 106 with tail portions 102 (described above) solderable to corresponding circuit traces on the printed circuit board. Each socket terminal 106 has a spring contact finger 108 projecting into a respective one of the passages 88 in housing 86 for receiving a respective one of the tail portions 62*a* and 64*a* of terminals 62 and 64, respectively, of header connector subassembly 16. It can be seen that the spring contact fingers 108 of terminals 106 are arranged in four rows corresponding to the four rows of terminating tail portions 62*a* and 64*a*. In comparing FIG. 6 with FIG. 4, it can be understood that receptacle 76 at the bottom of tail aligner 66 (FIG. 4) is positionable over housing 86 to mate header connector subassembly 16 with board-mounted connector subassembly 18**.

Still referring to FIG. 7, it can be seen how spring contact fingers 96 of each ground terminal 90 are located within cavities 110 of housing 86 of board-mounted connector subassembly 18. The spring contact fingers are adapted for mating with grounding tails 46 of grounding shrouds 38 and 40 when header connector subassembly 16 is mated with board-mounted Connector subassembly 18. FIG. 7 also shows that housing 86 includes a pair of mounting pegs 112 for insertion into corresponding mounting holes (not shown) in the printed circuit board.

With the above arrangement, neither grounding tails 46 of the grounding shrouds nor tail portions 62*a* or 64*a* of the header subassemblies are required to be soldered to printed circuit board 14. This assembly design therefore allows for removal of header connector subassembly 16 from board-mounted connector subassembly 18 without desoldering any terminals and, therefore, prevents damage to the circuit board and components and eliminates the costs associated with such removal. The modular arrangement and interengagement features of the header subassembly components further allows the entire header subassembly to be preassembled outside the environment of the electronic apparatus, to facilitate and simplify assembly, processing and repair. Furthermore, the board-mounted connector subassembly that is soldered to the circuit board includes terminals 106 having two rows of tail portions 102 corresponding to the four rows of pin-receiving contact fingers 108, as well as ground terminals 90 having soldering portions 94 corresponding to ground tail receiving contact fingers 96. Accordingly, the layout of the board-mounted connector subassembly enables easy visual inspection of the solder joints of all the tails and controls the proximity of rows for the soldered contacts on the board, thus, again, simplifying and facilitating the processing and assembly of the connections to the circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector assembly which provides an interconnection between the contacts of a pc card and the circuit traces of a printed circuit board, comprising:

a header connector Subassembly including a body adapted for receiving the pc card, a plurality of header terminals mounted on the body with pin portions adapted for interconnection with the receptacle contacts of the pc card, and a grounding shroud about said header terminals having a downwardly extending grounding tail portion; and a board-mounted connector subassembly including a housing adapted for mating with the body of the header connector subassembly, a plurality of socket terminals mounted on the housing for mating with the header terminals of the header connector subassembly and having tail portions adapted for interconnection with the circuit traces on the printed circuit board, and a ground terminal on the housing for mating with the grounding terminal portion of said shroud and including a solderable portion adapted for interconnection to a ground circuit on the printed circuit board, whereby the terminals of the header connector subassembly and the grounding tail portion of the grounding shroud are removably connected to the board-mounted connector subassembly so that the header connector subassembly is electrically and mechanically connected to the printed circuit board without soldering.

2. The electrical connector assembly of claim 1 wherein said header connector and board-mounted connector subassemblies are elongated and have opposite ends with the terminals extending in an array between the ends, and the grounding terminal portion of the grounding shroud and the mating ground terminal of the board-mounted connector subassembly are located at one end of the array of terminals.

3. The electrical connector assembly of claim 2, including one of said grounding terminal portions and its mating ground terminal at each opposite end of the array of terminals.

4. The electrical connector assembly of claim 2 wherein said grounding shroud is generally planar with said grounding terminal portion comprising a ground tail projecting generally perpendicular to the planar shroud.

5. The electrical connector assembly of claim 4, including one of said ground tails and its mating ground terminal at each opposite end of the array of signal terminals.

6. The electrical connector assembly of claim 1 wherein the terminals of said header connector subassembly include tail portions for mating with the socket terminals of the board-mounted connector subassembly, and including a tail aligner on the body of the header connector subassembly for receiving and positioning the tail portions.

7. The electrical connector assembly of claim 1 wherein said body is adapted for receiving a pair of pc cards in stacked relationship, and including a set of header terminals on the body for each pc card, with said grounding shroud being disposed between the sets of terminals.

8. The electrical connector assembly of claim 7 wherein said two sets of header terminals include an inner set and an outer set, and including a second grounding shroud about the header terminals in the outer set the second grounding shroud including a grounding terminal portion for mating with a ground terminal of the board mounted connector subassembly.

9. An electrical connector assembly which provides an interconnection between a pc card and a printed circuit board, the pc card including a plurality of receptacle contacts at one edge thereof and the printed circuit board including a plurality of circuit traces thereon, comprising:

a header connector subassembly including an elongated body for receiving the edge of the pc card, with the body defining opposite ends, a plurality of header terminals mounted in the body in an array between the opposite ends of the elongated body and with pin portions for mating with the receptacle contacts of the pc card, and a generally planar grounding shroud extending longitudinally between the opposite ends of the array of header terminals and including a ground tail projecting generally perpendicular to the planar shroud at each end thereof; and a board-mounted connector subassembly including an elongated housing adapted for mating with the elongated body of the header connector subassembly, the housing defining opposite ends thereof, a plurality of socket terminals mounted on the elongated housing in an array between the opposite ends thereof for mating with the header terminals of the header connector subassembly and with socket tail portions adapted for interconnection with the circuit traces on the printed circuit board, and a ground terminal at each opposite end of the elongated housing for receiving the ground tails at opposite ends of the shroud and with a solderable portion adapted for interconnection to a ground circuit on the printed circuit board.

10. The electrical connector assembly of claim 9 wherein said grounding shroud includes a plurality of fingers for engaging projections on an outer conductive surface of the pc card.

11. The electrical connector assembly of claim 9 wherein the header terminals of said header connector subassembly include tail portions for mating with the socket terminals of the board-mounted connector subassembly, and including a tail aligner on the body of the header connector subassembly for receiving and positioning the tail portions.

12. The electrical connector assembly of claim 11 wherein said tail aligner is independent of the body of the header connector.

13. An electrical connector assembly which provides an interconnection between the contacts of a pc card and the circuit traces of a printed circuit board, comprising:

a header connector subassembly including a two-part body with each body part adapted for receiving one of a pair of stacked pc cards, a plurality of header terminals on each body part with contact portions adapted for interconnection with the contacts of the respective pc card received by the body part, a first grounding shroud positioned between the two body parts and extending about said header terminals and including a downwardly extending grounding terminal portion, and a second grounding shroud on the outside of one of the body parts about the header terminals therein and including a downwardly extending grounding terminal portion; and a board-mounted connector subassembly including a housing adapted for mating with the two-part body of the header connector subassembly, a plurality of socket terminals on the housing for mating with the header terminals on both body parts of the header connector subassembly with socket tail portions adapted for interconnection with the circuit traces on the printed circuit board, and ground terminals on the housing for mating with the grounding terminal portions of the first and second shrouds and with solderable portions adapted for interconnection to ground circuit traces on the printed circuit board.

14. The electrical connector assembly of claim 13 wherein said header connector and board-mounted connector subassemblies are elongated and have opposite ends with the terminals extending in arrays between the ends, and the grounding terminal portions of each grounding shroud and the mating ground terminals of the board-mounted connector subassembly are located at one end of the array of signal terminals.

15. The electrical connector assembly of claim 14, including one of said grounding terminal portions of each grounding shroud and its mating ground terminal at each opposite end of the array of terminals.

16. The electrical connector assembly of claim 15 wherein each of said grounding shrouds is generally planar with said grounding terminal portion thereof comprising a ground tail projecting generally perpendicular to the respective planar shroud.

17. The electrical connector assembly of claim 16, including one of said ground tails and its mating ground terminal at each opposite end of each grounding shroud.

18. The electrical connector assembly of claim 13 wherein the header terminals of said header connector subassembly include tail portions for mating with the socket terminals of the board-mounted connector subassembly, and including a tail aligner on the body of the header connector subassembly for receiving and positioning the tail portions.

* * * * *